US007559169B2

(12) United States Patent
Hung et al.

(10) Patent No.: US 7,559,169 B2
(45) **Date of Patent: *Jul. 14, 2009**

(54) FIREARM AIMING AND PHOTOGRAPHING COMPOUND APPARATUS AND LASER SIGHT

(75) Inventors: Chih-Wei Hung, Taichung (TW); Shang-Yung Liang, Taichung (TW); Chia-Chen Chang, Taichung (TW)

(73) Assignee: Asia Optical Co., Inc., Taichung (TW)

( * ) Notice: Subject to any disclaimer, the term of this patent is extended or adjusted under 35 U.S.C. 154(b) by 399 days.

This patent is subject to a terminal disclaimer.

(21) Appl. No.: 11/478,103

(22) Filed: Jun. 29, 2006

(65) Prior Publication Data

US 2007/0214698 A1 Sep. 20, 2007

(30) Foreign Application Priority Data

Mar. 20, 2006 (TW) ..... 95204587 U

(51) Int. Cl.
*F41G 1/387* (2006.01)
*F41G 1/00* (2006.01)
*G03B 17/48* (2006.01)

(52) U.S. Cl. ..... 42/119; 42/146; 396/426

(58) Field of Classification Search ..... 42/119, 42/146, 842, 188, 304.4, 313.3, 314.2, 321.5, 42/457, 911; 33/266; 396/426; 89/36.01, 89/36.02, 36.03, 36.04, 36.07, 36.08, 36.09, 89/36.12, 36.17

See application file for complete search history.

(56) References Cited

U.S. PATENT DOCUMENTS

| | | | | |
|---|---|---|---|---|
| 5,675,112 | A * | 10/1997 | Giry et al. | 89/41.06 |
| 5,711,104 | A * | 1/1998 | Schmitz | 42/111 |
| 6,519,083 | B2 * | 2/2003 | Heinrich | 359/422 |
| 7,231,862 | B1 * | 6/2007 | Quinn | 89/41.05 |
| 7,437,848 | B2 * | 10/2008 | Chang | 42/119 |
| 2004/0050240 | A1 * | 3/2004 | Greene et al. | 89/41.06 |
| 2005/0252063 | A1 * | 11/2005 | Flannigan | 42/119 |
| 2006/0086032 | A1 * | 4/2006 | Valencic et al. | 42/70.01 |
| 2007/0028501 | A1 * | 2/2007 | Fressola et al. | 42/146 |
| 2007/0119296 | A1 * | 5/2007 | Niv et al. | 89/37.02 |
| 2007/0157502 | A1 * | 7/2007 | Holmberg | 42/124 |
| 2007/0214698 | A1 * | 9/2007 | Hung et al. | 42/111 |
| 2007/0230451 | A1 * | 10/2007 | Porat et al. | 370/357 |
| 2007/0261544 | A1 * | 11/2007 | Philippe | 89/41.05 |
| 2008/0010888 | A1 * | 1/2008 | Nerheim | 42/1.08 |
| 2008/0163536 | A1 * | 7/2008 | Koch et al. | 42/111 |

* cited by examiner

*Primary Examiner*—Bret Hayes
(74) *Attorney, Agent, or Firm*—Thomas, kayden, Horstemeyer & Risley

(57) ABSTRACT

A remote-controlled sight of a firearm has an aiming unit and a remote-controlled unit. The aiming unit is detachably disposed on a firearm body of the firearm and the remote-controlled unit connects to the firearm body. The remote-controlled unit has a button, a wireless transmitting module and a wireless receiving module, the wireless transmitting module is electrically connected to the button and the wireless receiving module is electrically connected to the aiming unit. When the button is pressed, a signal is transmitted from the wireless transmitting module and received by the wireless receiving module to actuate the aiming unit.

18 Claims, 12 Drawing Sheets

FIREARM AIMING AND PHOTOGRAPHING COMPOUND APPARATUS AND LASER SIGHT

RELATED APPLICATIONS

The present application is based on, and claims priority from, Taiwan Application Serial Number 95204587, filed Mar. 20, 2006, the disclosure of which is hereby incorporated by reference herein in its entirety.

BACKGROUND

1. Field of Invention

The present invention relates to a sight for a firearm, and more particularly, the present invention relates to a sight for a firearm via remote control.

2. Description of Related Art

Firearms, such as rifles or shotguns, are often equipped with digital sights providing aiming and photographic functions.

In a conventional digital sight, buttons controlling photography are assembled on a main body of the conventional digital sight. When a user aims at a target using the digital sight of a rifle and is ready to shoot the target, one hand thereof must support a butt of the rifle and the other hand slightly contact a trigger of the rifle. At this point, when the user also wants to capture an image of the target using the digital sight providing photographic functions, the hand preciously supporting the butt needs to move to the digital sight, pressing the buttons controlling photography. Accordingly, during the movement of the hand from the butt to the digital sight, a line of sight of the user may leave the target, thereby causing aiming errors. Additionally, as the hand of the user is moved to the digital sight, the other hand slightly contacting the trigger must bear the entire weight of the rifle. Accordingly, heavy burden is exerted on the other hand of the user, adversely affecting precision of aiming at or photographing the target.

Moreover, as shown in FIGS. 10,11 and 12, a conventional laser sight 101 is disposed on a firearm and has a housing 10, an objective lens assembly 11, an ocular lens assembly 12, a socket 13, a trigger circuit 14, and an extension button 17. The objective lens assembly 11 is connected to one end of the housing 10, and the ocular lens assembly 12 connected to the other end thereof. The socket 13 is disposed on the outer surface of the housing 10. The trigger circuit 14 is disposed in the housing 10 and electrically connected to the socket 13.

The sight 101 can output laser to the front of the objective lens assembly 11. By aiming at a target using the sight 101, the distance to the target can be obtained.

The Trigger circuit 14 has a fixed button 141 disposed on the housing 10. When the fixed button 141 is pressed, a power port of the trigger circuit 14 outputs a trigger signal, outputting the laser from the sight 101 or stopping the sight 101 from outputting the laser.

In practical application, the sight 101 is often used with a rifle as shown in FIG. 10. When a user is ready to shoot the target using the rifle, one hand (such as right hand) thereof contacts a trigger of the rifle and the other hand (such as left hand) supports the rifle and adjusts an aiming angle thereof. Accordingly, it is awkward to press the fixed button 141 to output/stop the laser while maintaining an aiming posture. The extension button 17 is thus required.

The extension button 17 is electrically connected to the socket 13 by an extension wire 15 and a plug 16. When the extension button 17 is pressed, the trigger circuit 14 is actuated, thereby selectively outputting or stopping the laser. The extension button 17 can be extended by the extension wire 15 and fixed in a suitable position for convenient operation. For example, as shown in FIG. 10, the extension button 17 may be fixed on the firearm and in front of the objective lens assembly 11. After the other hand (such as left hand) of the user adjusts the aiming angle, the extension button 17 can be easily pressed thereby, outputting the laser.

There are, however, many disadvantages when the extension button 17 is extended using the socket 13, extension wire 15, and plug 16.

The extension wire 15 promotes receipt of electromagnetic signals, increasing electromagnetic interference on the sight 101. Thus, outputting or stopping operation of the laser may be incorrect or operation of other electronic members in the sight 101 be adversely affected.

Further, waterproofing is not easily provided between the socket 13 and the plug 16, such that water may enter the sight 101, causing corrosion thereof.

Additionally, after the extension button 17 is positioned on the firearm, redundant extension wire 15 adversely affects aiming. Namely, the user must wind the extension wire 15 on the firearm in advance, causing inconvenience.

Hence, there is a need for a firearm aiming and photographing compound apparatus and a laser sight of a firearm to enhance precision, convenience of aiming at, photographing a target, lower the electromagnetic interference or improve the waterproof capability.

SUMMARY

It is therefore an objective of the present invention to provide a remote-controlled firearm aiming and photographing compound to enhance precision and convenience of aiming at or photographing a target.

It is therefore another objective of the present invention to provide a remote-controlled laser sight to lower the electromagnetic interference and has the waterproof capability.

In accordance with the foregoing objectives of the present invention, a firearm aiming and photographing compound apparatus has an aiming unit and a remote-controlled unit. The aiming unit is a digital sight and detachably disposes on a firearm body of the firearm. The remote-controlled unit is connected to the firearm body and has a button, a wireless transmitting module and a wireless receiving module. The wireless transmitting module is electrically connected to the button and the wireless receiving module is electrically connected to the aiming unit. When the button is pressed, a signal is transmitted from the wireless transmitting module and received by the wireless receiving module to actuate the aiming unit.

The digital sight has an image processing module and electrically connected to the wireless receiving module.

The remote-controlled unit further comprises a transmitter body and a flexible fixing strap. The button is disposed on the transmitter body, the transmitter body is connected to the flexible fixing strap, and the flexible fixing strap is movably fit on the firearm body.

The image processing module is actuated when the wireless receiving module receives the signal transmitted by the wireless transmitting module. The image processing module has a refractive prism, an image sensing unit, and a circuit board. The wireless receiving module and image sensing unit are electrically connected to the circuit board. The refractive prism is adjacent to the image sensing unit.

The digital sight further comprises a key set and an LCD display electrically connected to the circuit board, respectively.

The image processing unit is a CMOS sensor. The wireless transmitting module is an infrared transmitting module and the wireless receiving module is an infrared receiving module.

In accordance with another foregoing objective of the present invention, a laser sight has an aiming unit and a remote-controlled unit.

The aiming unit is detachably disposed on the firearm body and has a housing, an objective lens assembly, an ocular lens assembly, and a laser module. The housing surrounds an axial line. The objective lens assembly is connected to one end of the housing. The ocular lens assembly is connected to the other end of the housing. The laser module is disposed in the housing and is capable of outputting laser toward the objective lens assembly.

The remote-controlled unit has a button, a wireless transmitting module, and a wireless receiving module. The wireless transmitting module is electrically connected to the button. The wireless receiving module is electrically connected to the laser module and disposes in the housing. When the button is pressed to actuate the wireless transmitting module, enabling the laser module to output the laser by way of the wireless receiving module via remote control.

The wireless receiving module is an infrared receiving circuit, the wireless transmitting module is an infrared transmitting circuit corresponding to the infrared receiving circuit, the infrared receiving circuit has a receiving member, and the infrared transmitting circuit has a transmitting member.

The housing further comprises a transparent portion. The button and wireless transmitting module are disposed on the firearm body and near the transparent portion. Signals output from the transmitting member are transmitted into the receiving member via the transparent portion or via the objective lens assembly.

The remote-control unit further comprises a transmitter body disposes on the firearm body and a fixing strap connects to the transmitter body. The button and wireless transmitting module are disposed in the transmitter body. The transmitter body is disposed on the firearm body by the fixing strap.

The user can simultaneously maintain the aiming posture and press the button. In another aspect, when the button is pressed, the signals output from the wireless transmitting module pass through the objective lens assembly and are transmitted to the wireless receiving module. At this point, the wireless receiving module actuates the laser module, thereby outputting or stopping the laser.

It is to be understood that both the foregoing general description and the following detailed description are by examples, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

The following description is of the best-contemplated mode of carrying out the invention. This description is made for the purpose of illustrating the general principles of the invention and should not be taken in a limiting sense. The scope of the invention is best determined by reference to the appended claims.

First Embodiment

Figure 1:
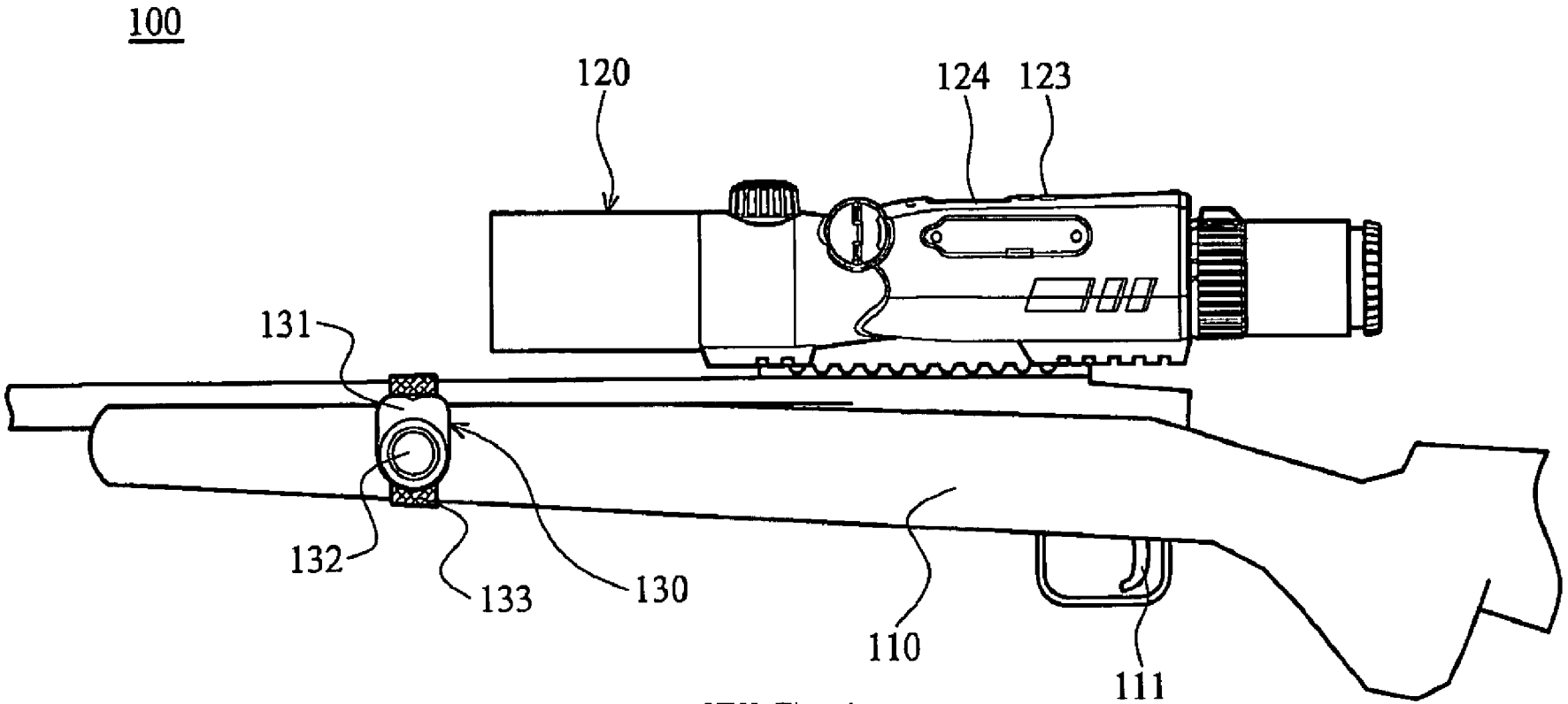
FIG. 1 is a schematic plan view of a firearm aiming and photographing compound apparatus of a first embodiment of the invention.
Figure 2:
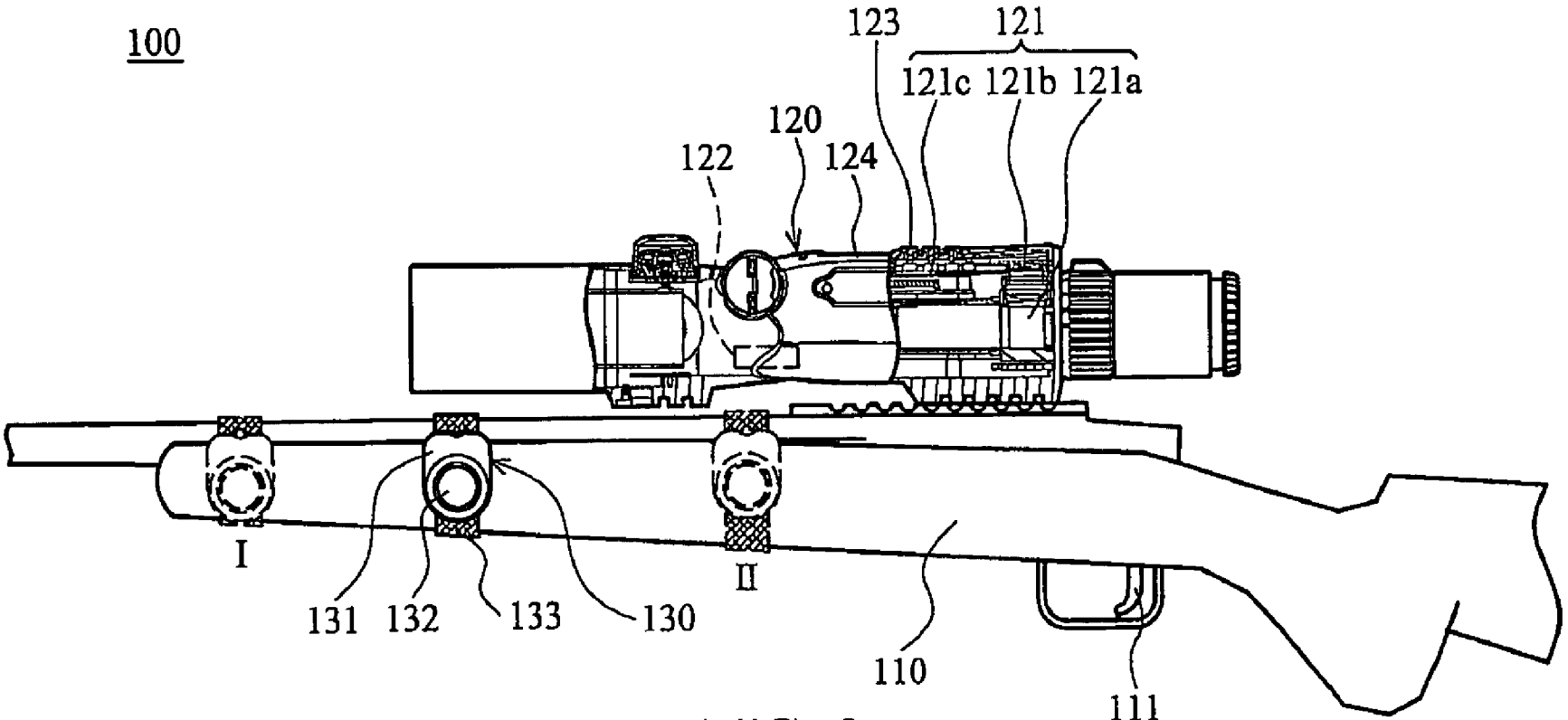
FIG. 2 is a schematic plan view illustrates partial inner structure of the firearm aiming and photographing compound apparatus of the first embodiment of the invention.

Referring to FIG. 1 and FIG. 2, a firearm aiming and photographing compound apparatus 100 has a digital sight 120, and a remote-controlled unit 130.

A firearm body 110 of this embodiment may be a butt of a rifle or a shotgun.

The remote-control unit 130 is movably connected to the firearm body 110 and is capable of emitting a signal. Specifically, as shown in FIG. 1 and FIG. 2, the remote-control unit 130 has a transmitter body 131, a button 132, a wireless transmitting module (not shown, which disposed in the transmitter body), a wireless receiving module 122 and a flexible fixing strap 133. The button 132 is disposed on the transmitter body 131. The transmitter body 131 is connected to the flexible fixing strap 133. The flexible fixing strap 133 is movably fit on the firearm body 110. By the flexible fixing strap 133, the remote-control transmitter 130 can be positioned between a first position I and a second position II on the firearm body 110, as shown in FIG. 2.

The digital sight 120 is disposed on the firearm body 110 and has an image processing module 121, a key set 123, and an LCD display 124. The wireless receiving module 122 of the remote-control unit 130 is electrically connected to the image processing module 121. Specifically, as shown in FIG. 2, the image processing module 121 has a refractive prism 121*a*, an image sensing unit 121*b*, and a circuit board 121*c*. The image sensing unit 121*b*, wireless receiving module 122, key set 123, and LCD display 124 are electrically connected to the circuit board 121*c*, respectively. The refractive prism 121*a* is adjacent to the image sensing unit 121*b*. When transmitted to the digital sight 120, light with images is refracted, by the refractive prism 121*a*, to the image sensing unit 121*b* and received thereby. At this point, the images are displayed on the LCD display 124 and can be captured by operating the key set 123. Moreover, the image sensing unit 121*b*, of this embodiment, may be a CMOS sensor.

When a user aims at a target using the digital sight 120 of the firearm aiming and photographing compound apparatus 100 and is ready to shoot the target, one hand supports the firearm body 110 (butt) and the other hand slightly contacts a trigger 111 of the firearm body 110. At this point, when also wanting to photograph the target using the digital sight 120, the user can press the button 132 of the remote-controlled unit 130 directly by the hand supporting the firearm body 110, forcing the transmitter body 131 (for example, wireless transmitting module) to emit a signal. Accordingly, the wireless receiving module 122 receives the signal emitted from the transmitter body 131 (for example, wireless transmitting module) and thereby actuates the image processing module 121. The image of the target is thus captured.

Accordingly, while aiming at the target, the user can press the button 132 of the remote-controlled unit 130 by a thumb without removing the hand from the firearm body 110 (butt). Thus, a line of sight of the user does not leave the target, and aiming posture does not change, ensuring precision of aiming at or photographing the target. Further, because the user can captured the image of the target without removing the hand from the firearm body 110 (butt) and adjust the position of the remote-controlled unit 130 on the firearm body 110 (butt) as required, convenience of operation of the firearm aiming and photographing compound apparatus 100 is enhanced.

Moreover, the wireless transmitting module may be an infrared transmitting module, and the wireless receiving module 122 may be an infrared receiving module.

Second Embodiment

Figure 3:
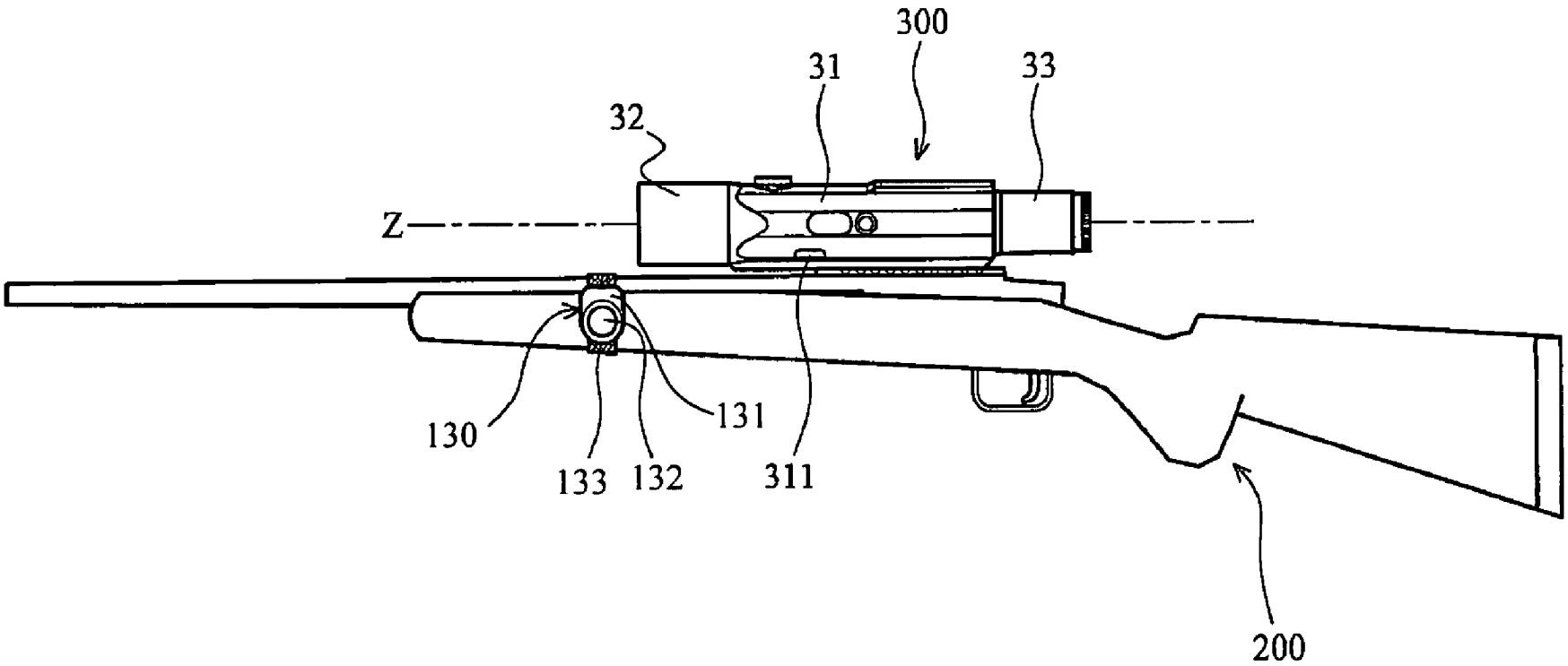
FIG. 3 is a schematic plan view of a laser sight of a second embodiment of the invention.
Figure 4:
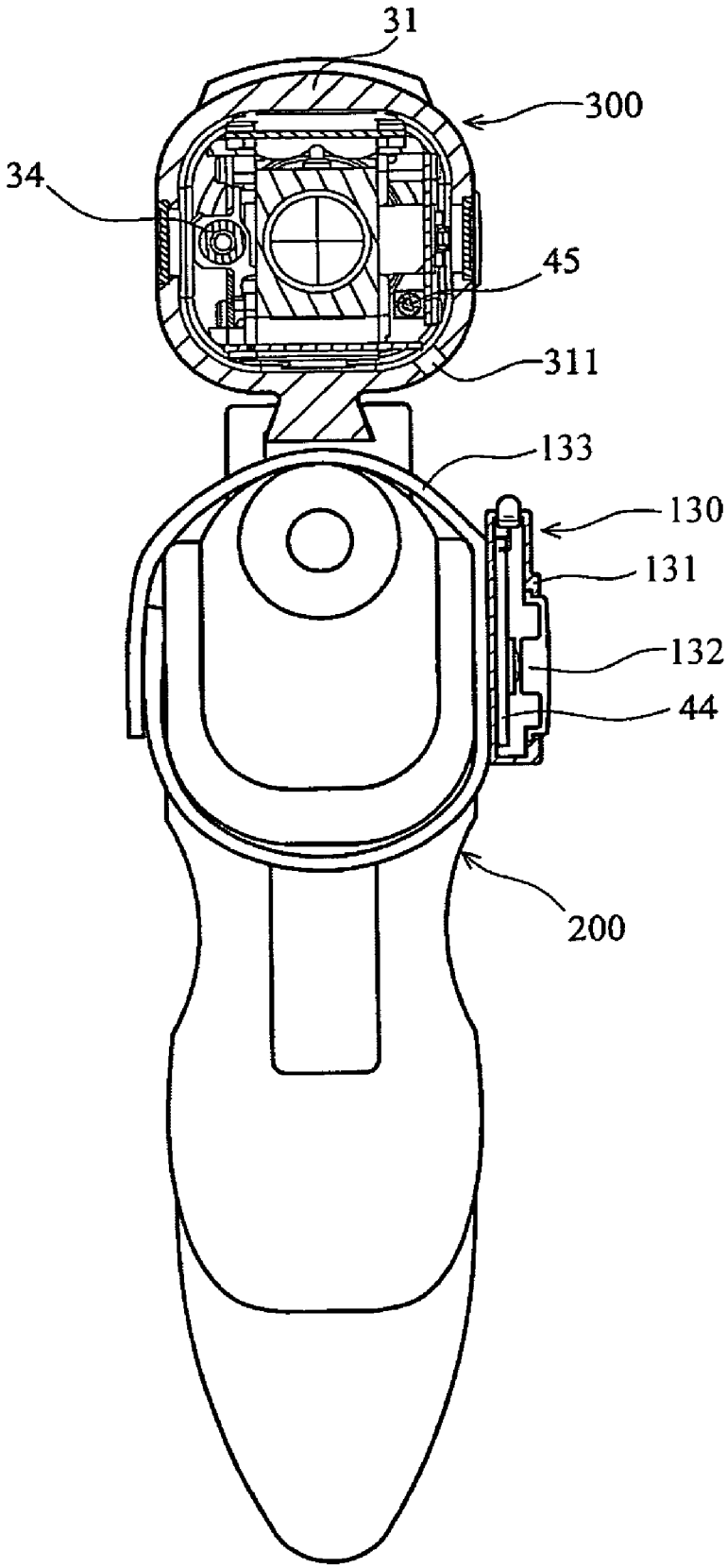
FIG. 4 is a partial plan view and cross section of the laser sight of the second embodiment of the invention.
Figure 5:
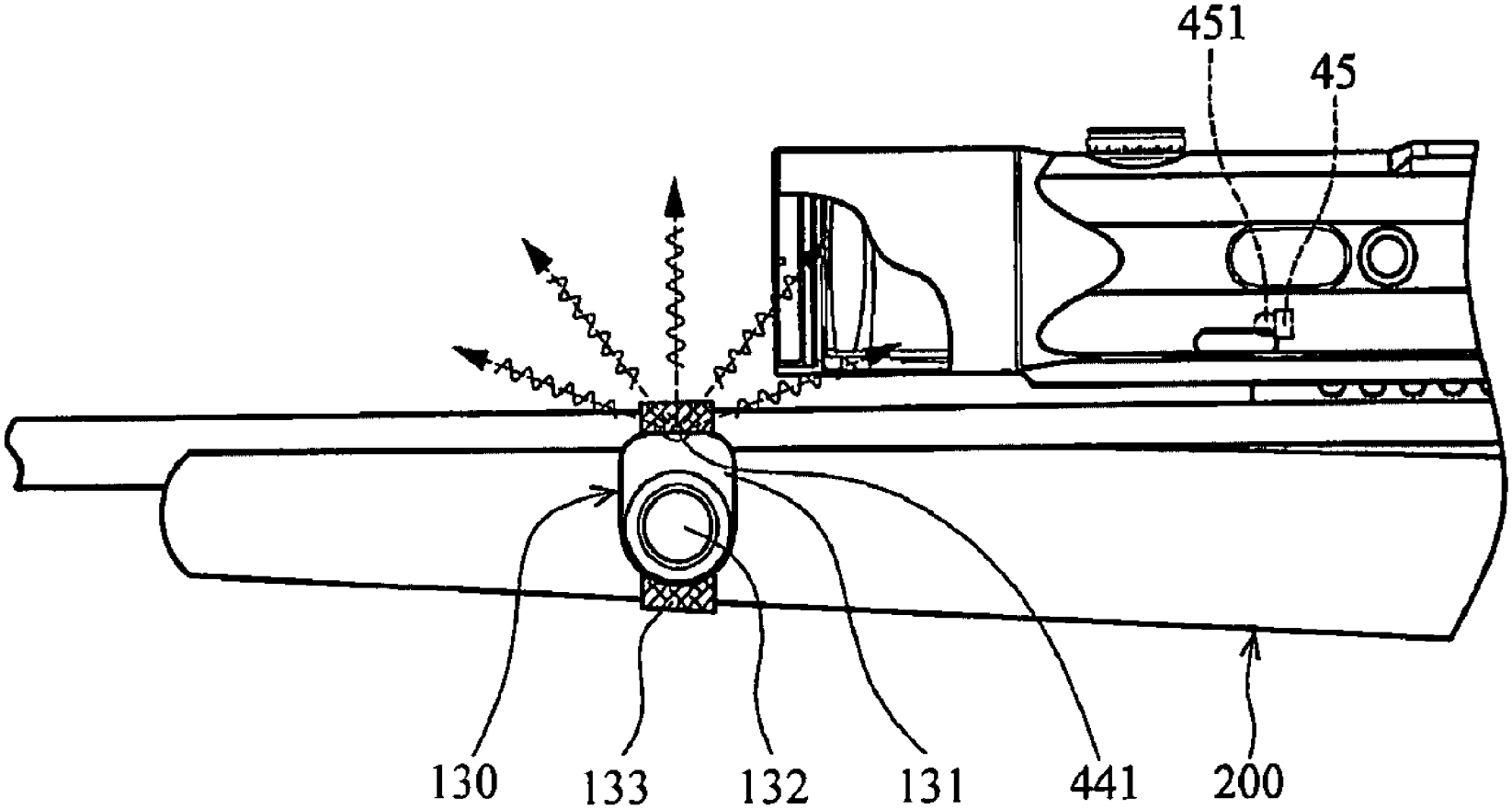
FIG. 5 is a partial plan view of an aiming unit and a remote-controlled unit of the laser sight of the second embodiment of the invention.
Figure 6:
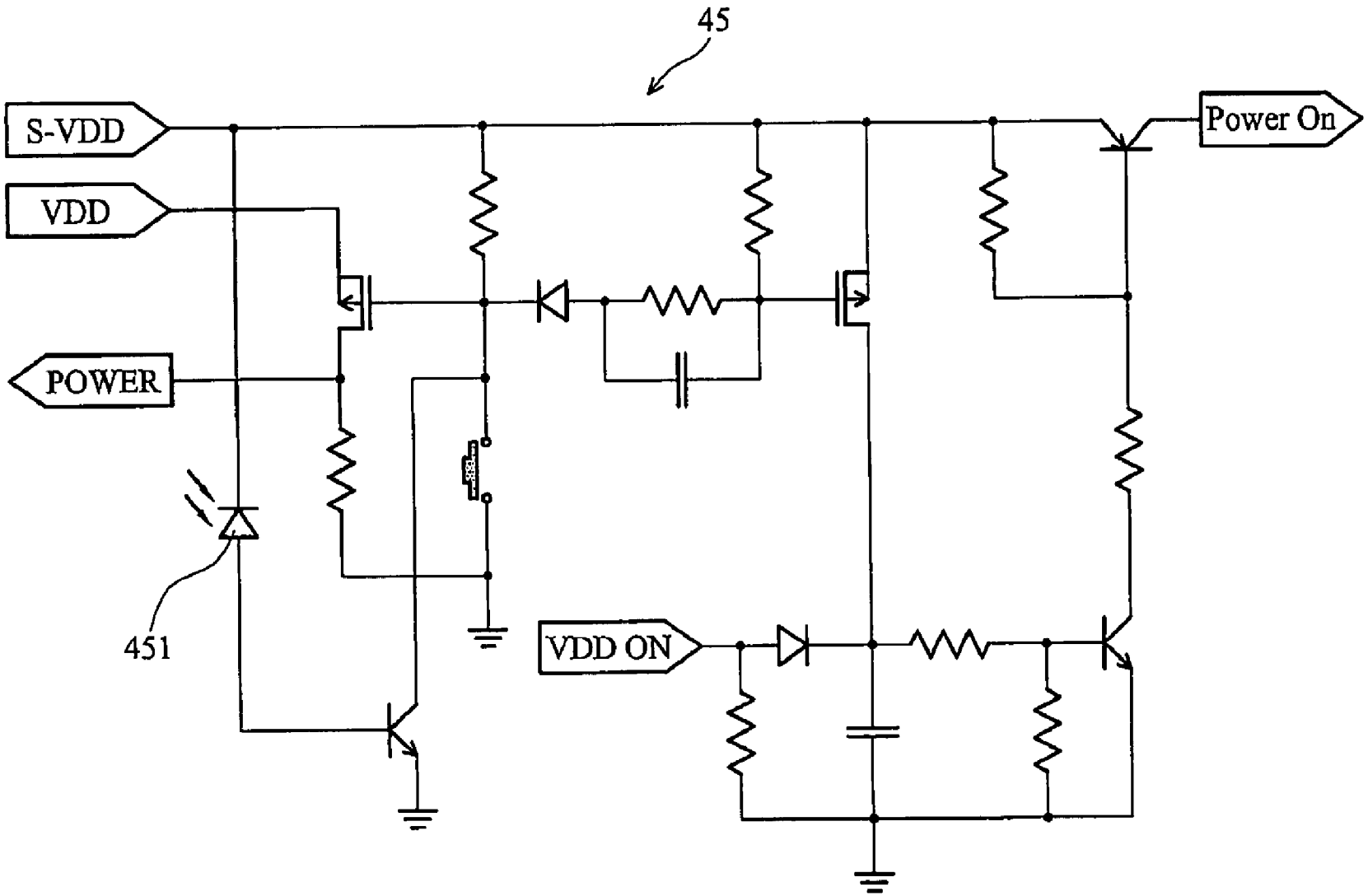
FIG. 6 is a schematic circuit diagram of a wireless receiving module of the laser sight of the second embodiment of the invention.
Figure 7:
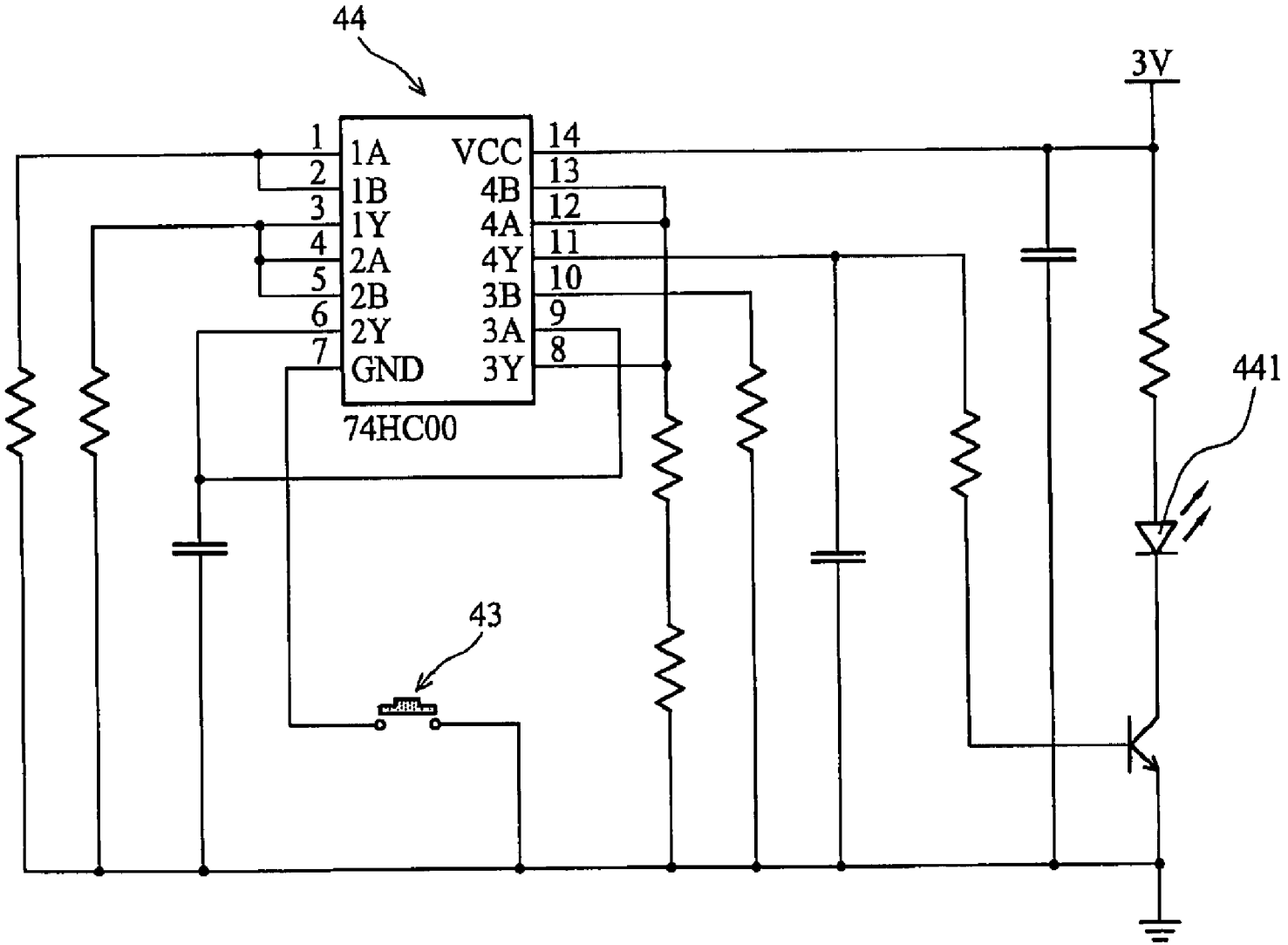
FIG. 7 is a schematic circuit diagram of a wireless transmitting module of the laser sight of the second embodiment of the invention.

Referring to FIGS. 3, 4, and 5, a laser sight with remote-controlled capability is disposed on a firearm body 200 and has an aiming unit 300 and a remote-controlled unit 130.

The aiming unit 300 is detachably disposed on the firearm body 200 and has a housing 31, an objective lens assembly 32, an ocular lens assembly 33, and a laser module 34. The housing 31 surrounds an axial line Z. The objective lens assembly 32 is connected to one end of the housing 31 and the ocular lens assembly 33 connected to the other end thereof. The laser module 34 is disposed in the housing 31, outputting laser toward the objective lens assembly 32.

The housing 31 has a transparent portion 311 facing downward and near the objective lens assembly 32.

Referring to FIGS. 4, 5, 6 and 7, the remote-control unit 130 has a transmitter body 131, a flexible fixing strap 133, a button 132, a wireless transmitting module 44, and a wireless receiving module 45. The flexible fixing strap 133 is connected to the transmitter body 131. The button 132 is disposed in the transmitter body 131. The wireless transmitting module 44 is disposed in the transmitter body 131 and electrically connected to the button 132. The wireless receiving module 45 is electrically connected to laser module 34. The transmitter body 131 is disposed on the firearm body 200 by the flexible fixing strap 133.

The button 132 can actuate the wireless transmitting module 44 and enable the laser module 34 to output the laser by way of the wireless receiving module 45.

The wireless receiving module 45 is an infrared receiving circuit disposed in the housing 31 and adjacent to the transparent portion 311. The infrared receiving circuit has a receiving member 451.

The wireless transmitting module 44 is an infrared transmitting circuit corresponding to the infrared receiving circuit. The infrared transmitting circuit has a transmitting member 441. Signals output from the transmitting member 441 can be transmitted to the receiving member 451 via the objective lens assembly 32 or via the transparent portion 311.

Figure 8:
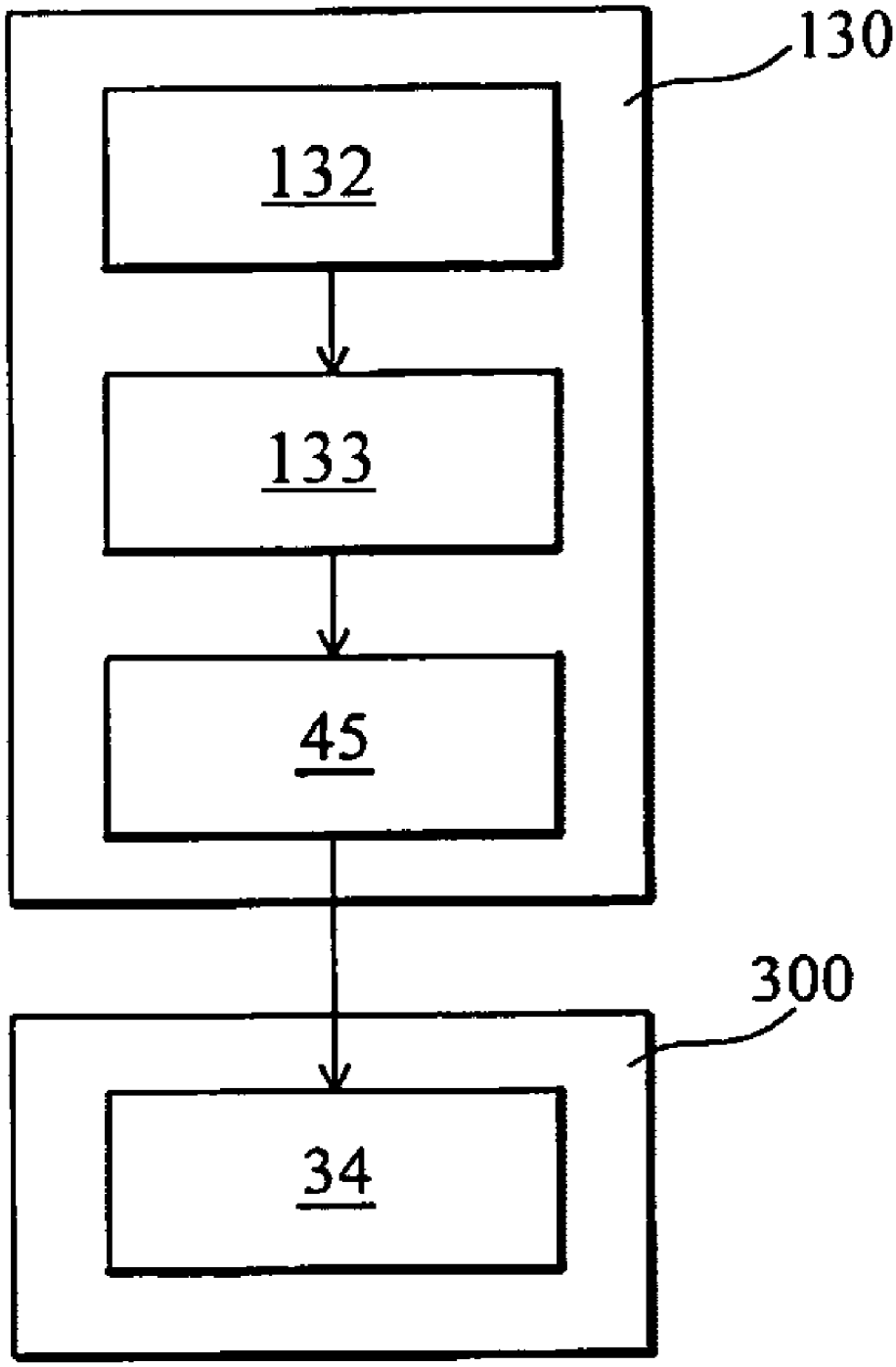
FIG. 8 is a block diagram illustrates connection and operation of the aiming unit and remote-controlled unit of the laser sight of the second embodiment of the invention.

Referring to FIG. 5 and FIG. 8, the remote-controlled unit 130 may be disposed in a proper position on the firearm body 200 for convenient operation of the laser sight. Thus, a user may easily control or operate the aiming unit 300 without changing an aiming posture thereof.

For example, when a user prepares to shoot in a prone position, one hand (such as right hand) thereof must hold the firearm body 200 and be near a trigger and the other hand (such as left hand) stretch to the front of the objective lens assembly 32 to support the firearm body 200 and adjust an aiming angle thereof. To conveniently output or stop the laser, the button 132 can be moved to the front of the objective lens assembly 32. Accordingly, the user can simultaneously maintain the aiming posture and press the button 132. In another aspect, when the button 132 is pressed, the signals output from the wireless transmitting module 44 pass through the objective lens assembly 32 and are transmitted to the wireless receiving module 45. At this point, the wireless receiving module 45 actuates the laser module, thereby outputting or stopping the laser.

Figure 9:
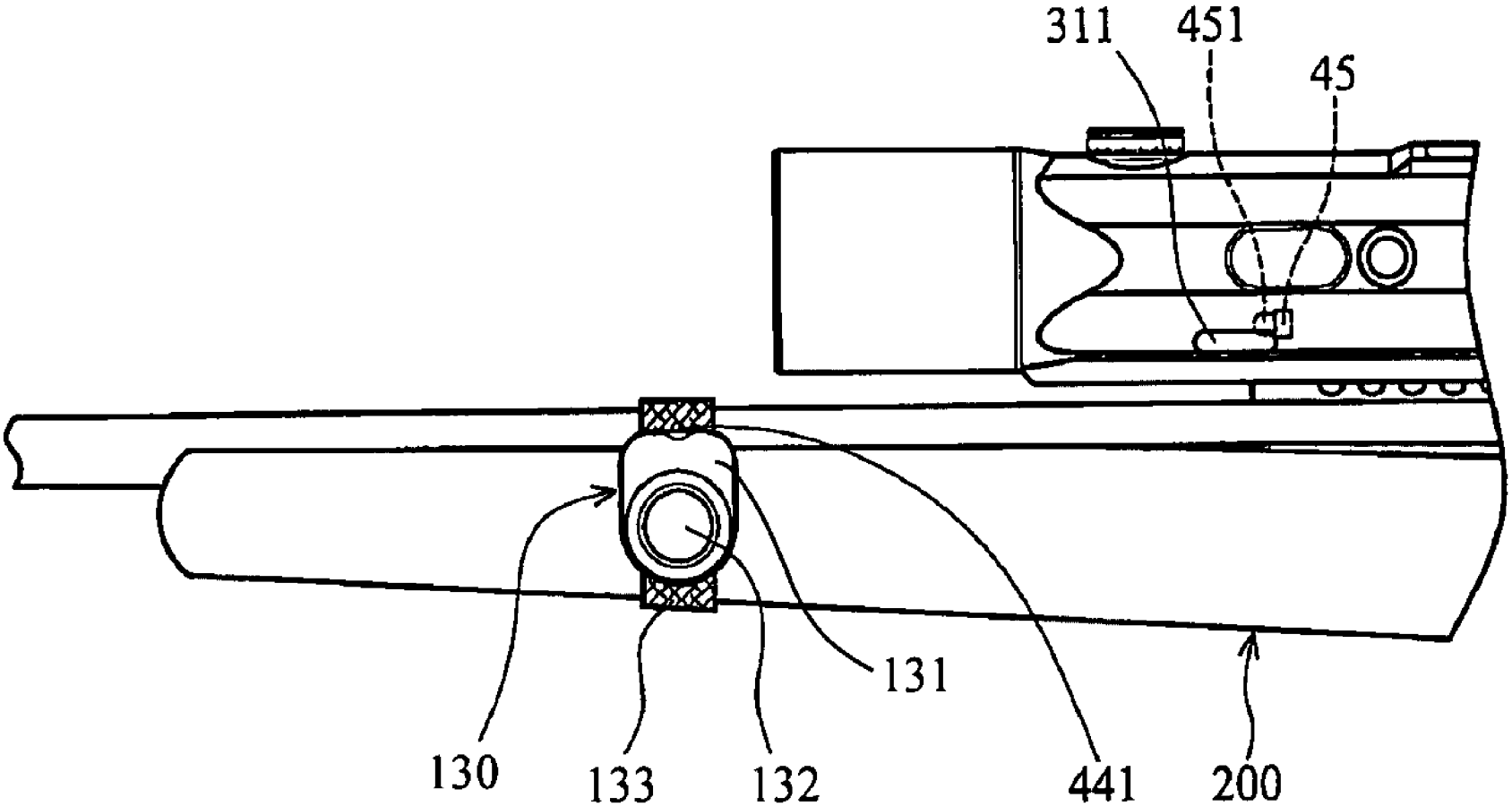
FIG. 9 is another partial plan view of the aiming unit and remote-controlled unit of the laser sight of the second embodiment of the invention.
Figure 10:
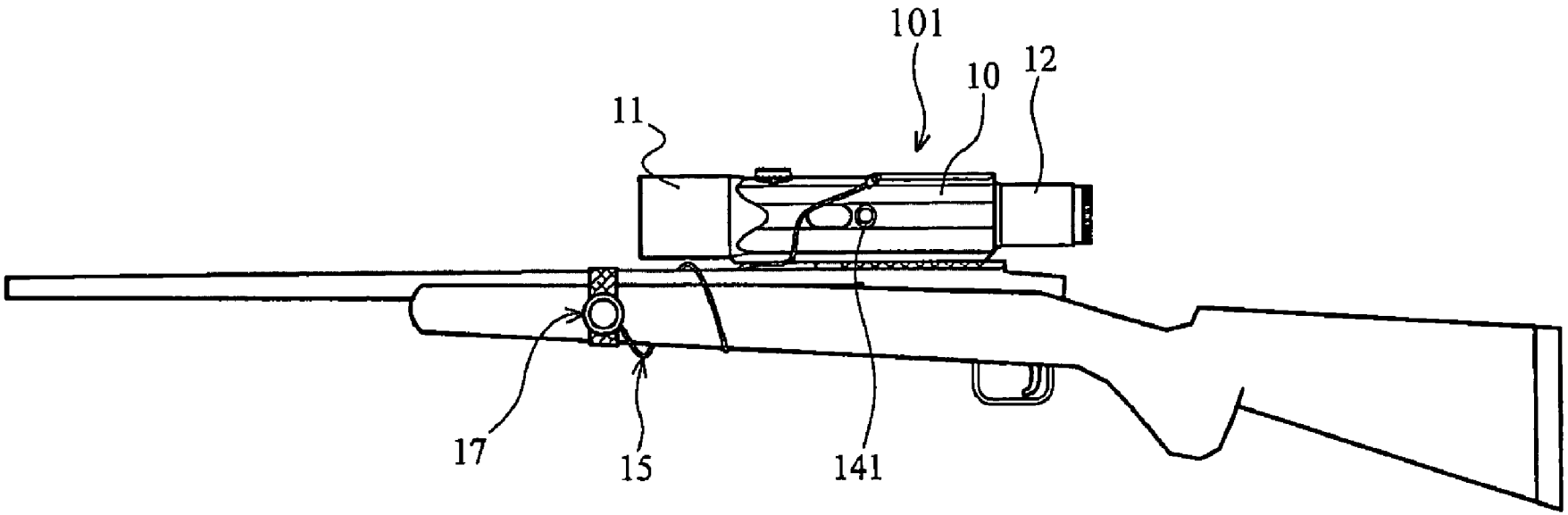
FIG. 10 (PRIOR ART)
FIG. 10 is a schematic plan view of a conventional sight assembled on a firearm.
Figure 11:
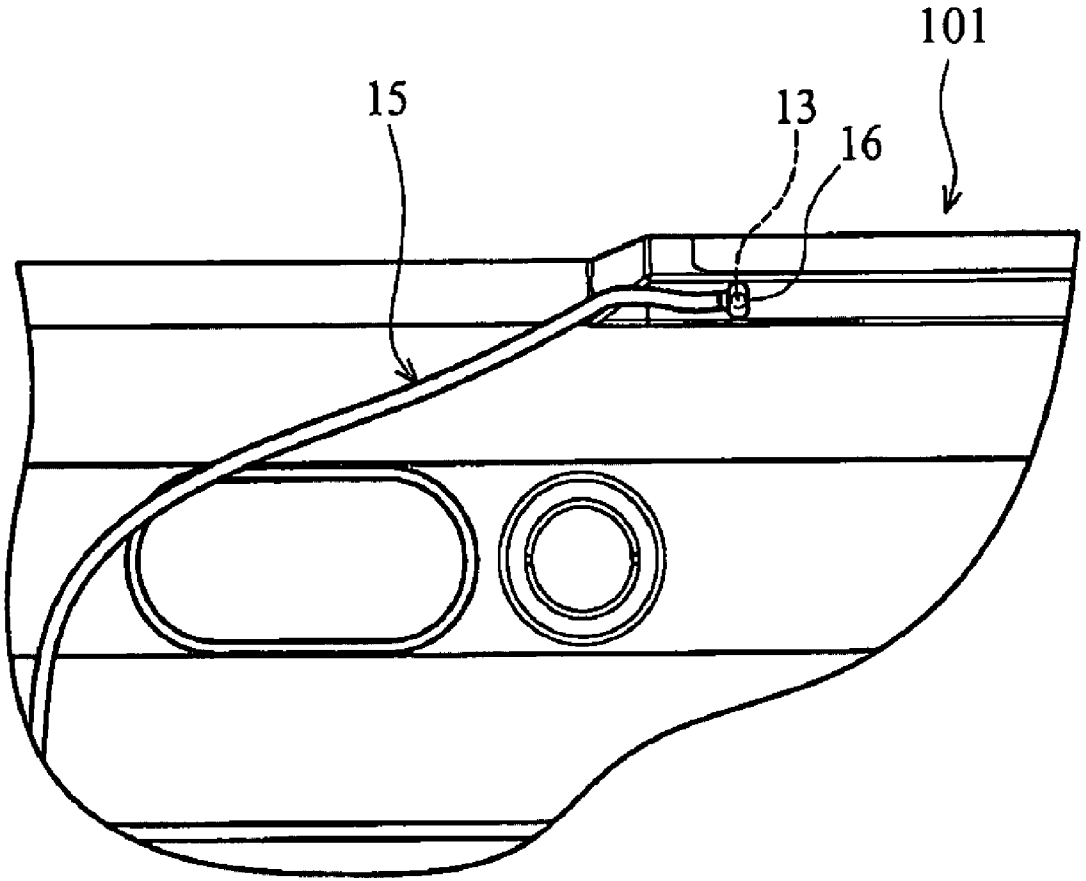
FIG. 11 (PRIOR ART)
FIG. 11 is a partial enlarged view of FIG. 10 illustrates a plug connected to a socket.
Figure 12:
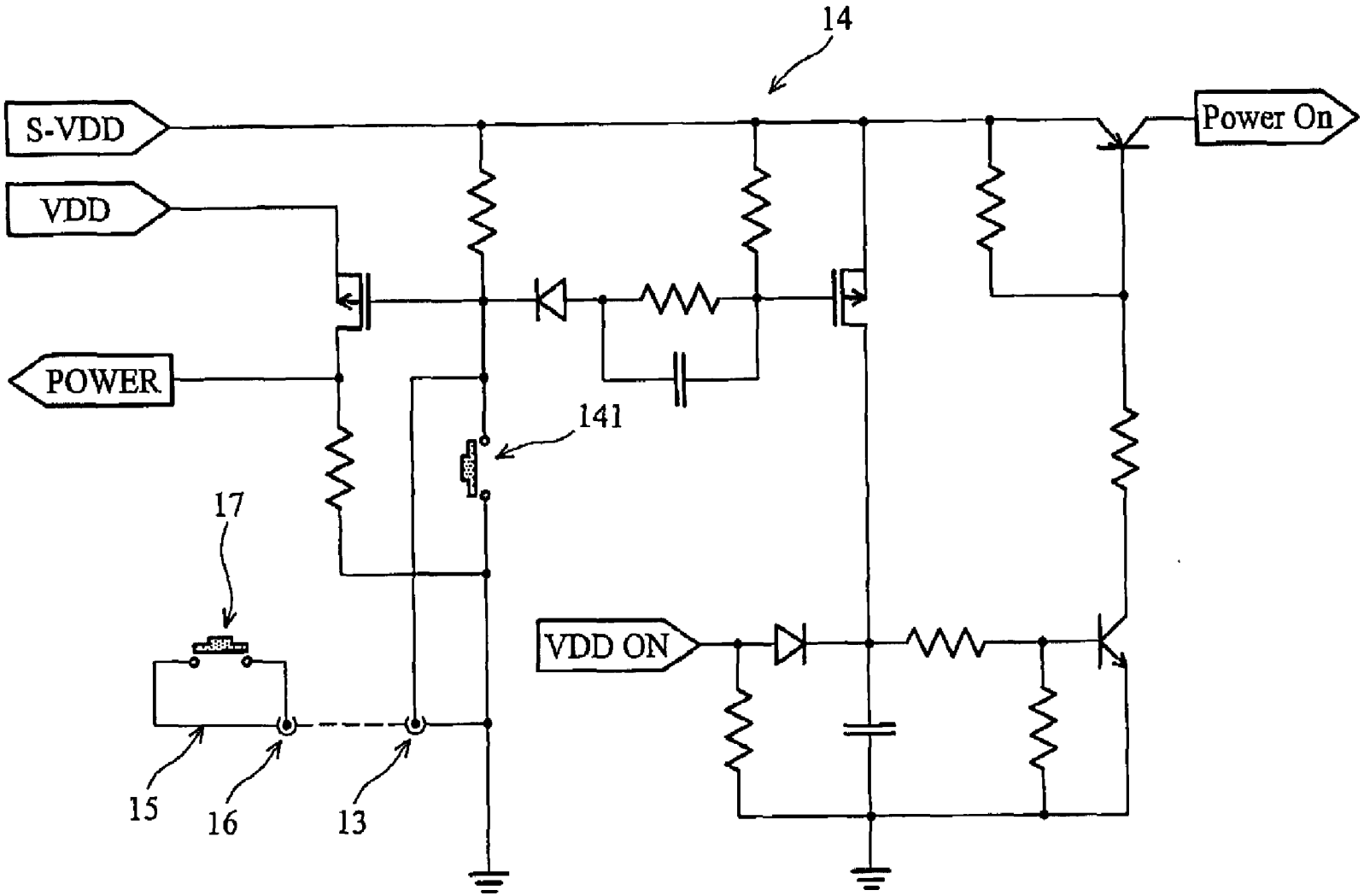
FIG. 12 (PRIOR ART)
FIG. 12 is a schematic circuit diagram of a trigger circuit of the conventional sight.

Referring to FIG. 9, when the user prepares to shoot in a standing position, the other hand (such as left hand) thereof is often below the objective lens assembly 32. The button 132 can be moved to the underside of the objective lens assembly 32. When the button 132 is pressed, the signals output from the wireless transmitting module 44 pass through the transparent portion 311 and are transmitted to the wireless receiving module 45, thereby controlling the laser module 34.

As the disclosed laser sight is not provided with any extension wire, plug, or socket, receipt of electromagnetic signals and electromagnetic interference are reduced and water cannot enter the laser sight. Moreover, as the disclosed laser sight is not provided with any extension wire, aiming operation of the laser sight is not obstructed thereby.

Accordingly, the disclosed laser sight can be operated by a user in a prone position, a standing position, or other shooting position, overcoming the disadvantages of the conventional sight.

Specifically, during manufacture of the laser sight, the wireless transmitting module 44 can also be provided with an RF transmission circuit. As the RF transmission circuit provides non-directional, unlimited transmission angle, and object-penetrable characteristics, the transparent portion 311 can be omitted, also achieving the same operation of the aiming unit 300.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangement.

What is claimed is:

1. A remote-controlled sight for a firearm, comprising:

an aiming unit, detachably disposed on a firearm body of the firearm, comprising an image processing module comprising:

a circuit board;

an image sensing unit electrically connected to the circuit board; and a refractive prism adjacent to the image sensing unit;

a remote-controlled unit, connected to the firearm body and comprising at least a button, a wireless transmitting module and a wireless receiving module, wherein the wireless transmitting module is electrically connected to the button and the wireless receiving module is electrically connected to the circuit board; and wherein when the button is pressed, a signal is transmitted from the wireless transmitting module and received by the wireless receiving module to actuate the aiming unit.

2. The remote-controlled sight for a firearm as claimed in claim 1, wherein the remote-controlled sight is a firearm aiming and photographing compound apparatus and the aiming unit is a digital sight.

3. The remote-controlled sight for a firearm as claimed in claim 1, the remote-controlled unit further comprises a transmitter body and a flexible fixing strap, the button is disposed on the transmitter body, the transmitter body is connected to the flexible fixing strap, and the flexible fixing strap is movably fit on the firearm body.

4. The remote-controlled sight for a firearm as claimed in claim 1, wherein the image processing module is actuated when the wireless receiving module receives the signal from the wireless transmitting module.

5. The remote-controlled sight for a firearm as claimed in claim 4, wherein the wireless transmitting module is an infrared transmitting module and the wireless receiving module is an infrared receiving module.

6. The remote-controlled sight for a firearm as claimed in claim 1, the digital sight further comprises a key set and an LCD display electrically connected to the circuit board, respectively.

7. The remote-controlled sight for a firearm as claimed in claim 1, wherein the image processing unit is a CMOS sensor.

8. A remote-controlled sight for a firearm, comprising:

an aiming unit, detachably disposed on a firearm body of the firearm, comprising a housing, an objective lens assembly, an ocular lens assembly and a laser module; and a remote-controlled unit, connected to the firearm body and comprising at least a button, a wireless transmitting module and a wireless receiving module, wherein the wireless transmitting module is electrically connected to the button and the wireless receiving module is electrically connected to the aiming unit;

wherein the wireless receiving module is disposed in the housing and electrically connected to the laser module, when the button is pressed to actuate the wireless transmitting module, a signal is transmitted from the wireless transmitting module and received by the wireless receiving module to actuate the aiming unit, enabling the laser module to output the laser by way of the wireless receiving module via remote control.

9. The remote-controlled sight for a firearm as claimed in claim 8, wherein the remote-controlled sight is a laser sight.

10. The remote-controlled sight for a firearm as claimed in claim 8, wherein the housing surrounds an axial line, the objective lens assembly is connected to one end of the housing, the ocular lens assembly is connected to the other end of the housing, and the laser module is disposed in the housing and is capable of outputting a laser toward the objective lens assembly.

11. The remote-controlled sight for a firearm as claimed in claim 10, wherein the wireless receiving module is disposed in the housing and electrically connected to the laser module, and press the button to actuate the wireless transmitting module, enabling the laser module to output the laser by way of the wireless receiving module via remote control.

12. The remote-controlled sight for a firearm as claimed in claim 11, wherein the wireless receiving module is an infrared receiving circuit, the wireless transmitting module is an infrared transmitting circuit corresponding to the infrared receiving circuit, the infrared receiving circuit comprises a receiving member, and the infrared transmitting circuit comprises a transmitting member.

13. The remote-controlled sight for a firearm as claimed in claim 12, the housing further comprises a transparent potion, the button and wireless transmitting module are disposed on the firearm body and near the transparent portion, and signals output from the transmitting member are transmitted into the receiving member via the transparent portion.

14. The remote-controlled sight for a firearm as claimed in claim 13, the remote-controlled unit further comprises a transmitter body disposed on the firearm body, and the button and wireless transmitting module are disposed in the transmitter body.

15. The remote-controlled sight for a firearm as claimed in claim 14, the remote-controlled unit further comprises a fixing strap connected to the transmitter body, and the transmitter body is disposed on the firearm body by the fixing strap.

16. The remote-controlled sight for a firearm as claimed in claim 12, wherein the button and wireless transmitting module are disposed on the firearm body and in front of the objective lens assembly, and signals output from the transmitting member are transmitted into the receiving member via the objective lens assembly.

17. The remote-controlled sight for a firearm as claimed in claim 16, the remote-controlled unit further comprises a transmitter body disposes on the firearm body, and the button and wireless transmitting module are disposed in the transmitter body.

18. The remote-controlled sight for a firearm as claimed in claim 17, the remote-controlled unit further comprises a fixing strap connects to the transmitter body, and the transmitter body is disposed on the firearm body by the fixing strap.

* * * * *